United States Patent [19]

Pura

[11] Patent Number: 4,962,621

[45] Date of Patent: Oct. 16, 1990

[54] MODULAR BRICK CHIMNEY UNIT

[76] Inventor: Michael A. Pura, R.D. 1, Box 91, Johnsonburg, Pa. 15845

[21] Appl. No.: 365,855

[22] Filed: Jun. 13, 1989

[51] Int. Cl.[5] ..... E04H 12/28

[52] U.S. Cl. ..... 52/218; 52/747

[58] Field of Search ..... 52/268–271, 52/218, 219, 244, 606, 607, 747, 2 R

[56] References Cited

U.S. PATENT DOCUMENTS

| | | | |
|---|---|---|---|
| 114,883 | 5/1871 | Toepfer . | |
| 473,853 | 4/1892 | Raymond | 52/244 |
| 841,415 | 1/1907 | Merton | 52/270 |
| 909,412 | 1/1909 | Howe | 52/244 |
| 1,170,936 | 2/1916 | Royse | 52/606 |
| 1,279,978 | 9/1918 | Brooks | 52/219 |
| 1,924,044 | 8/1933 | MacDougall | 52/271 |
| 2,342,058 | 2/1944 | Morris . | |
| 2,591,906 | 4/1952 | Altmann | 52/606 |
| 3,303,618 | 2/1967 | Kelsey | 52/269 |
| 3,721,225 | 3/1973 | Tidwell | 52/219 |

FOREIGN PATENT DOCUMENTS

| | | | |
|---|---|---|---|
| 336469 | 10/1930 | United Kingdom | 52/218 |

*Primary Examiner*—James L. Ridgill, Jr.

*Attorney, Agent, or Firm*—Berman, Aisenberg & Platt

[57] ABSTRACT

A modular chimney unit includes a plurality of courses of joined bricks forming a closed shape and having a channel therethrough for receiving a section of chimney flue liner. Modular units of the invention are stacked vertically and joined, with the channels in vertical alignment, until the required chimney height is reached. A method of constructing a chimney using modular units is also described.

6 Claims, 1 Drawing Sheet

MODULAR BRICK CHIMNEY UNIT

FIELD OF THE INVENTION

The invention relates to prefabricated modular units for a chimney.

BACKGROUND OF THE INVENTION

When a chimney is being built, it is advantageous to be able to complete the construction rapidly, in order to save time and also to avoid bad weather. Modular units may be made at a remote location and transported to the building site.

The patent to Toepfer, U.S. Pat. No. 114,883, describes a cast iron smoke stack made in sections, both vertically and horizontally, so that the sections may be transported nested together. Each vertical section of smoke stack is divided into four circumferential sections which are assembled on-site. The Brooks patent, U.S. Pat. No. 1,279,978, describes a chimney sleeve having telescoping sections. The chimney sleeve acts as a liner to protect against fire, particularly where the chimney passes through the building rafters, such as at floor and roof levels. The patent to Morris, U.S. Pat. No. 2,342,058, describes prefabricated sections of chimney stack, each section having an outer shell covering an insulated lining.

Kelsey, U.S. Pat. No. 3,303,618, describes a prefabricated chimney having an outer shell of insulating material and an inner refractory lining. The insulating material may also be covered by an outer refractory lining, if required. Tidwell, U.S. Pat. No. 3,721,225, describes a prefabricated fireplace assembled on-site. The outer chimney sections are cast prefabricated sections, assembled into a chimney, around a flue, on-site.

SUMMARY OF THE INVENTION

A modular chimney unit of the invention is fabricated from a plurality of bricks to form sections of a chimney through which a flue passes. Each unit is prefabricated of a plurality of courses of joined bricks, each course forming a closed shape with an interior channel for receiving a section of chimney flue liner.

Typically, a modular chimney unit is made of bricks, and may have three courses of bricks joined in a square or rectangular shape having an open channel in the center of the structure for receiving a section of chimney flue liner.

In a method for constructing a chimney, modular units are joined in stacked vertical adjacent relationship and sections of chimney liner are inserted within the stacked units. The units are stacked and joined until the required chimney height is reached.

An object of the invention is to provide a prefabricated modular chimney unit made of joined bricks.

A further object of the invention is to provide a method for constructing a chimney from modular units.

DETAILED DESCRIPTION OF THE INVENTION

A modular chimney unit of the invention has a plurality of courses of joined bricks forming a closed shape with a channel through the unit for receiving a section of chimney flue liner. The modular units are stacked vertically and joined using mortar, similar to the mortar with which the bricks are joined, in order to build the chimney to the required height. When sufficient units are joined together, a flue liner is inserted within the channel and then further modular units are stacked on the already built structure, further flue liners are added and secured in place, until the required chimney height is reached.

A modular chimney unit is preferably made of bricks, and may be made in any required size or shape by increasing or decreasing the number of rows of bricks used, and the number of courses of bricks. In a non-limiting example, a typical modular unit has one row of bricks around an interior channel and three vertically arranged courses of bricks. Although a chimney is usually square or rectangular, modular units of the invention may be constructed in any desired shape.

Figure 1:
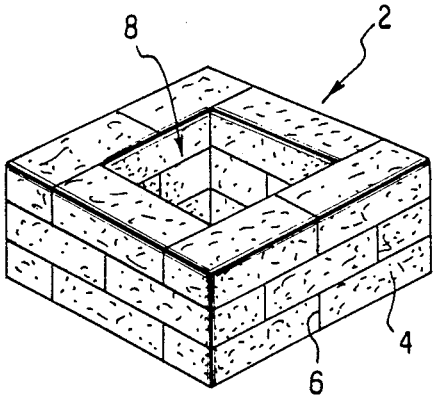
FIG. 1 is a perspective view of a modular chimney unit of the invention.
Figure 2:
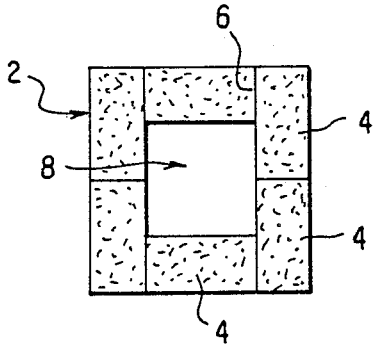
FIG. 2 is a top plan view of the modular chimney unit of FIG. 1.
Figure 3:
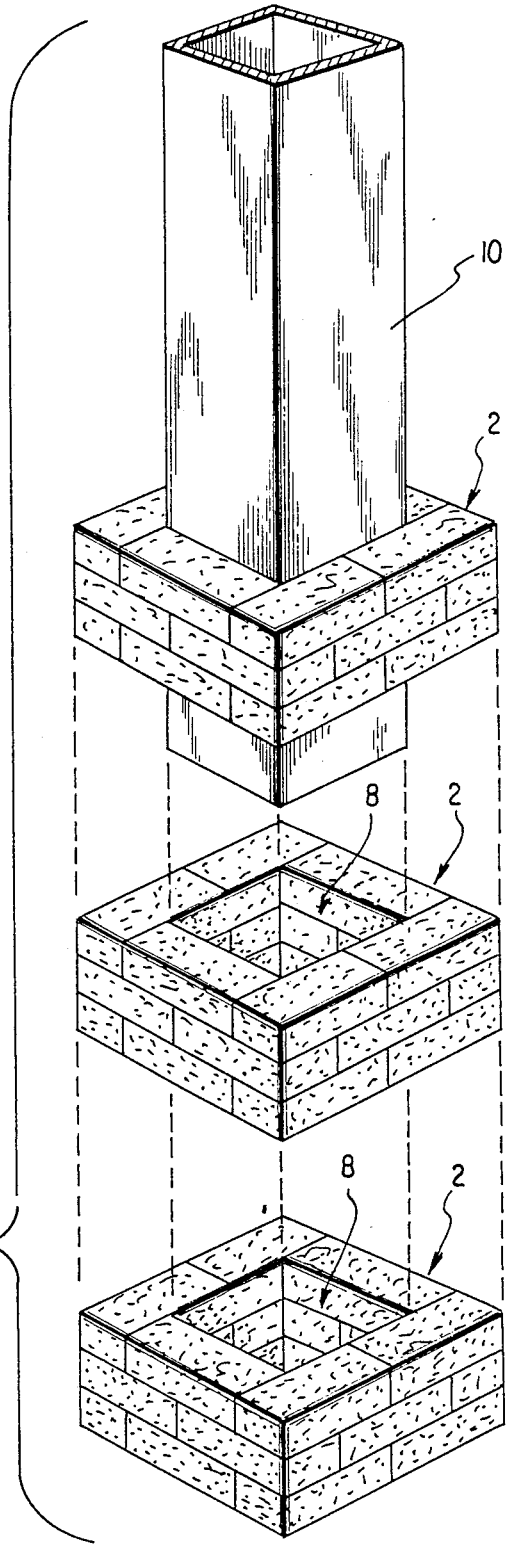
FIG. 3 is an exploded perspective view showing assembly of a chimney using modular chimney units of the invention.

With reference to FIGS. 1 to 3, in which like numerals represent like parts, FIG. shows a perspective view of modular chimney unit 2. Modular unit 2 is composed of three courses of bricks 4 joined together by mortar joints 6 or joints of other appropriate material, known in the art.

FIGS. 1 and 2 show a modular unit 2 in which each course of bricks 4 is made from six units positioned so that channel 8 passes through each unit 2. Channel 8 is sized for receiving a section of chimney liner which forms a flue liner for a fireplace. FIG. 3 shows the manner in which modular units 2 are stacked in vertical adjacent relationship, with channels 8 vertically aligned. When an appropriate number of units 2 have been joined in vertical adjacent relationship, a flue liner 10 is inserted through channel 8 of each unit. After flue liner 10 has been inserted and cemented in place, further units 2 may be assembled on top of the units already in place, with channels 8 vertically aligned for receiving further sections of flue liner 10. This method is repeated until the required chimney height is reached.

While, for reasons of economy and convenience, it will generally be most practical for the modular units to be constructed with a single row of bricks surrounding channel 8, unit 2 may include two or more rows of bricks in each course. Modular units 2 may be constructed of any size or shape, according to need.

While the invention has been described with respect to certain embodiments thereof, it will be appreciated that variations and modifications may be made without departing from the spirit and scope of the invention.

What is claimed is:

1. A prefabricated modular chimney unit comprising a plurality of courses of joined bricks forming a closed shape and having channel means therethrough for receiving a section of chimney flue liner.

2. A modular chimney unit according to claim 1 comprising at least three courses of joined bricks.

3. A modular chimney unit according to claim 1 wherein each course of bricks comprises at least one row of bricks joined to each other in a closed shape surrounding an open channel.

4. A chimney comprising:

a plurality of prefabricated modular chimney units wherein each unit comprises a plurality of courses of joined bricks forming a closed shape including a channel therethrough for receiving a chimney flue liner, said units being joined in vertical arrangement with said channels in vertical alignment, and a plurality of joined sections of chimney flue liner engaged through said vertically aligned channels.

5. A method of constructing a chimney comprising:

(a) prefabricating a plurality of modular units for forming wall sections of a chimney having a flue therethrough, wherein each modular unit comprises a plurality of courses of joined bricks forming a closed shape and having an open channel therethrough for receiving a section of flue liner;

(b) joining a plurality of said prefabricated modular units in vertical adjacent relationship, channels through said units being vertically aligned for receiving a section of flue liner; and (c) inserting a section of flue liner through said vertically aligned channels.

6. A method according to claim 5 further comprising repeating steps (b) and (c) as many times as necessary to reach the required height of the chimney.

* * * * *